US007808307B2

(12) United States Patent
Sakiyama et al.

(10) Patent No.: US 7,808,307 B2
(45) Date of Patent: Oct. 5, 2010

(54) REFERENCE CURRENT CIRCUIT, REFERENCE VOLTAGE CIRCUIT, AND STARTUP CIRCUIT

(75) Inventors: Shiro Sakiyama, Kyoto (JP); Akinori Matsumoto, Osaka (JP); Takashi Morie, Osaka (JP); Masayoshi Kinoshita, Osaka (JP)

(73) Assignee: Panasonic Corporation, Osaka (JP)

( * ) Notice: Subject to any disclaimer, the term of this patent is extended or adjusted under 35 U.S.C. 154(b) by 26 days.

(21) Appl. No.: 12/093,393

(22) PCT Filed: Sep. 4, 2007

(86) PCT No.: PCT/JP2007/067212

§ 371 (c)(1),
(2), (4) Date: May 12, 2008

(87) PCT Pub. No.: WO2008/032606

PCT Pub. Date: Mar. 20, 2008

(65) Prior Publication Data

US 2009/0115502 A1 May 7, 2009

(30) Foreign Application Priority Data

Sep. 13, 2006 (JP) ..... 2006-247818

(51) Int. Cl.
*G05F 1/10* (2006.01)

(52) U.S. Cl. ..... 327/541; 327/538; 327/539

(58) Field of Classification Search ..... 327/535, 327/537–541, 543; 323/312, 313
See application file for complete search history.

(56) References Cited

U.S. PATENT DOCUMENTS

| | | | | |
|---|---|---|---|---|
| 5,818,294 | A * | 10/1998 | Ashmore, Jr. | 327/543 |
| 5,910,749 | A * | 6/1999 | Kimura | 327/541 |
| 6,191,646 | B1 * | 2/2001 | Shin | 327/543 |
| 6,489,835 | B1 * | 12/2002 | Yu et al. | 327/539 |
| 7,233,195 | B2 * | 6/2007 | Oh | 327/538 |
| 2004/0004501 | A1 | 1/2004 | Shimizu et al. | |
| 2005/0127889 | A1 | 6/2005 | Wada | |
| 2005/0140428 | A1 | 6/2005 | Tran et al. | |
| 2006/0164158 | A1 | 7/2006 | Kimura | |

FOREIGN PATENT DOCUMENTS

| | | |
|---|---|---|
| JP | 11-045125 | 2/1999 |
| JP | 2003/051739 | 2/2003 |
| JP | 3586073 | 8/2004 |
| JP | 2005/196738 | 7/2005 |
| JP | 2006/209212 | 8/2006 |

* cited by examiner

*Primary Examiner*—Hai L Nguyen
(74) *Attorney, Agent, or Firm*—McDermott Will & Emery LLP

(57) ABSTRACT

A current mirror circuit 10 is formed to have a current ratio (a transistor size ratio) of 1:m. As well, respective pairs of nMOS transistors MN1, MN3 and nMOS transistors MN2, MN4 are formed to have a current ratio of 1:m. Two currents output from the current mirror circuit 10 are each distributed to two. The distributed currents flowing in the nMOS transistors MN2, MN4 are added and are then allowed to flow into one resistor R2. Hence, for the resistor R2, only one resistor in which current of double flows suffices when m=1, for example. This effortlessly reduces the necessary resistance to one fourth.

17 Claims, 15 Drawing Sheets

FIG. 1

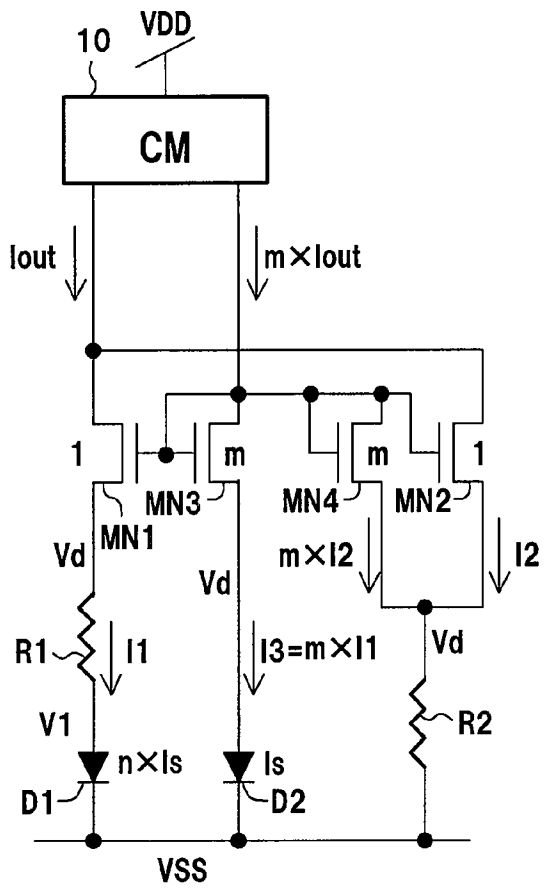

(Expression 1) $$I_1 = nIs\exp\left(\frac{qV_1}{kT}\right)$$

(Expression 2) $$I_3 = mI_1 = Is\exp\left(\frac{qV_d}{kT}\right)$$

(Expression 3) $$V_d - V_1 = \frac{kT}{q}\ln(mn)$$

(Expression 4) $$I_1 = \frac{V_d - V_1}{R_1} = \frac{1}{R_1}\frac{kT}{q}\ln(mn)$$

(Expression 5) $$I_2 = \frac{1}{1+m}\frac{V_d}{R_2}$$

(Expression 6) $$I_{out} = \frac{1}{R_1}\frac{kT}{q}\ln(mn) + \frac{1}{1+m}\frac{1}{R_2}V_d$$

(Expression 7) $$\frac{\partial I_{out}}{\partial T} = \frac{1}{R_1}\frac{k}{q}\ln(mn) + \frac{1}{1+m}\frac{1}{R_2}\frac{\partial V_d}{\partial T} = 0$$

(Expression 8) $$A = \frac{-\frac{\partial V_d}{\partial T}}{\frac{k}{q}\ln(mn)}$$

(Expression 9) $$R_2 = A\frac{1}{(1+m)}R_1$$

(Expression 8) $A = \dfrac{-\dfrac{\partial V_d}{\partial T}}{\dfrac{k}{q}\ln(mn)}$ (Expression 10) $R_{all} = R_1 + R_2 = A\dfrac{1}{(1+m)}R_1 + R_1$.

Given that: m=1; n=27; k=1.38×10$^{-23}$ (J/K); q=1.6×10$^{-19}$ (C); and $\dfrac{\partial V_d}{\partial T} = -2mV/K,$ the followings are lead:

(Expression 11) A ≒ 7

(Expression 12) R2≒3.5×R1

(Expression 13) Rall ≒ 4.5×R1

FIG. 15 PRIOR ART

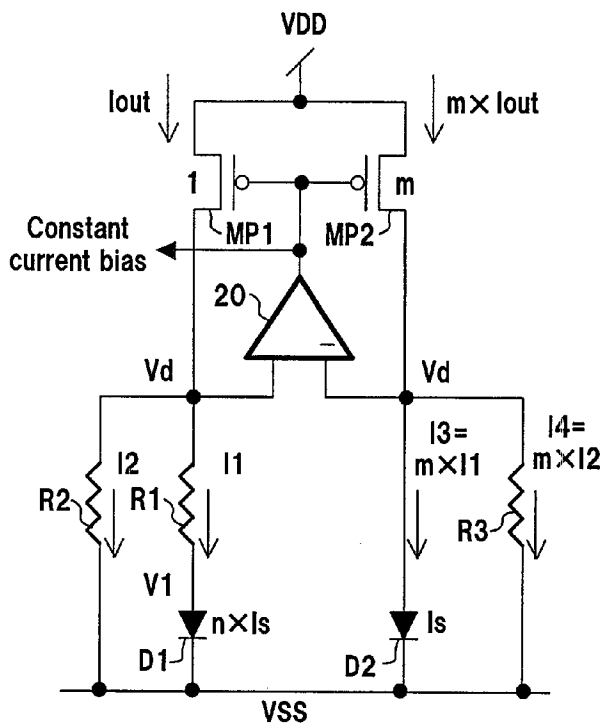

(Expression 21) $R_3 = \frac{1}{m} R_2$ (Expression 22) $I_4 = mI_2 = m\frac{V_d}{R_2} = \frac{V_d}{R_3}$ (Expression 23) $I_1 = nIs\exp\left(\frac{qV_1}{kT}\right)$ (Expression 24) $I_3 = mI_1 = Is\exp\left(\frac{qV_d}{kT}\right)$ (Expression 25) $V_d - V_1 = \frac{kT}{q}\ln(mn)$ (Expression 26) $I_1 = \frac{V_d - V_1}{R_1} = \frac{1}{R_1}\frac{kT}{q}\ln(mn)$ (Expression 27) $I_2 = \frac{V_d}{R_2}$ (Expression 28) $I_{out} = \frac{1}{R_1}\frac{kT}{q}\ln(mn) + \frac{1}{R_2}V_d$ (Expression 29) $\frac{\partial I_{out}}{\partial T} = \frac{1}{R_1}\frac{k}{q}\ln(mn) + \frac{1}{R_2}\frac{\partial V_d}{\partial T} = 0$ (Expression 30) $A = \frac{-\frac{\partial V_d}{\partial T}}{\frac{k}{q}\ln(mn)}$ (Expression 31) $R_2 = AR_1$ (Expression 32) $R_3 = A\frac{1}{m}R_1$ (Expression 30) $$A = \frac{-\frac{\partial V_d}{\partial T}}{\frac{k}{q}\ln(mn)}$$

(Expression 33) $$R_{all} = R_1 + R_2 + R_3 = A\left(\frac{1+m}{m}\right)R_1 + R_1$$

Given that: m=1;
n=27;
$k=1.38\times10^{-23}$ (J/K);
$q=1.6\times10^{-19}$ (C); and
$\frac{\partial V_d}{\partial T} = -2mV/K$, the followings are lead:

(Expression 34) $A \fallingdotseq 7$ (Expression 35) $R2=R3 \fallingdotseq 7\times R1$ (Expression 36) $Rall \fallingdotseq 15\times R1$

REFERENCE CURRENT CIRCUIT, REFERENCE VOLTAGE CIRCUIT, AND STARTUP CIRCUIT

RELATED APPLICATIONS

This application is the U.S. National Phase under 35 U.S.C. §371 of International Application No. PCT/JP2007/067212, filed on Sep.4, 2007, which in turn claims the benefit of Japanese Application No. 2006-247818, filed on Sep.13, 2006, the disclosures of which Applications are incorporated by reference herein.

TECHNICAL FIELD

The present invention relates to a reference current circuit, a reference voltage circuit, and a startup circuit which use a band gap reference circuit.

BACKGROUND ART

In general, various semiconductor devices including an analog circuit use a reference voltage circuit using a band gap reference (hereinafter referred to it as BGR) circuit for suppressing variation in characteristics caused due to power supply voltage variation or the temperature variation. It is known that reference voltage that the BGR type reference voltage circuit generates less depends on the power supply voltage variation and the temperature variation.

Similarly, a reference current having less power supply voltage dependency and less temperature dependency can be obtained generally by converting a voltage obtained in a BGR type reference voltage circuit as above to a current. As well, a BGR type reference current circuit is known recently which directly obtains a constant reference current (see Patent Document 1, for example).

The BGR type reference current circuit of Patent Document 1 will now be described with reference to FIG. 15.

A conventional circuit shown in FIG. 15 is composed of a current mirror circuit including two pMOS transistors (MP1, MP2), two diodes (D1, D2), three resistors (R1, R2, R3), and an operation amplifier 20. The operation amplifier 20 feedback-controls the gate potentials of the pMOS transistors MP1, MP2 so that the drain potentials of the pMOS transistors MP1, MP2 become equal to each other.

The two pMOS transistors MP1, MP2 are so designed to have a current ratio (a transistor size ratio) of 1:m (where m is an integer equal to or larger than 1, for example). Respective pairs of two resistors R2, R3 and the diodes D1, D2 are so designed that the respective current ratios of the currents flowing therein become 1:m, as well. The two diodes (D1, D2) are so set that the ratio of the reverse saturation currents thereof (a size ratio of the diodes) becomes n:1 (where n is an integer larger than 1, for example). Further, the resistances of R1 to R3, the diode ratio n, and the current ratio m are so designed that the current variation caused due to the temperature variation becomes small.

More specifically, the conventional circuit is designed as follows, for example.

The resistance of the resistor R3 is so designed to have a ratio to the resistance of the resistor R2 equal to the above current ratio, 1:m (Expression 21 indicated in combination in FIG. 15). In this case, the ratio of the current I2 flowing in the resistor R1 to the current I4 flowing in the resistor R3 becomes 1:m, as well (Expression 22). Accordingly, the ratio of the current I1 flowing from the resistor R1 to the diode D1 to the current I3 flowing therefrom to the diode D2 becomes 1:m (I3=m·I1), as well.

On the other hand, the relationship between the current I1 flowing in the diode D1 and the anode potential V1 is expressed by Expression 23. Further, the current I3 is m times the current I1, as described above, and accordingly, the relationship between the current I3 (=m·I1) and the anode potential Vd of the diode D2 is expressed by Expression 24, where Is is a reverse saturation current of the diode D2, n is a ratio of the reverse saturation currents of the diodes D1, D2, k is a Boltzmann constant, T is an absolute temperature, and q is an electron charge amount.

Accordingly, the voltage across the resistor R1 and the current I1 flowing therein are expressed by Expressions 25 and 26, respectively.

The current I2 flowing in the resistor R2 is expressed by Expression 27, and therefore, the current Iout flowing in the pMOS transistor MP1 can be obtained by adding Expressions 26 and 27 (Expression 28). Referring to Expression 28, with no VDD depending terms, the current Iout of an ideal element will not vary by the power supply voltage variation.

The temperature coefficient of the current Iout with respect to the absolute temperature is obtained by partially differentiating Expression 28 by the absolute temperature T (Expression 29). In Expression 29, the first term is a positive value of a coefficient with respect to the absolute temperature T while the gradient (∂Vd/∂T) of Vd with respect to the absolute temperature in the second term is a negative value. Accordingly, when the values of R1, R2, m, and n are so set that the value of Expression 29 as the temperature coefficient of the current Iout becomes zero, the current Iout becomes independent from temperature.

Specifically, given that the value A is defined as in Expression 30, the resistor R2 is set as in Expression 31 with respect to the resistor R1. As well, the resistor R3 is set as in Expression 32 from this and Expression 21.

The total resistance Rall necessary for forming the above reference current circuit is expressed by Expression 33 in FIG. 16 from summation of the resistances of R1 to R3. In order to minimize the total current value, it is desirable that the current ratio of the currents flowing in the pMOS transistors MP1, MP2 is set to m=1. Further, as k (Boltzmann constant)=1.38 E−23 and q (electron charge)=1.6 E−19, setting of n=27 and ∂Vd/∂T=−2 mV/K leads to A≈7 (Expression 34).

Accordingly, R2=R3≈7·R1 (Expression 35) and the total resistance Rall≈15·R1 (Expression 36) are lead, which means that a resistance of approximately 15 times the resistance of the resistor R1 as a reference is necessary.

Consequently, in order to obtain smaller current consumption and a smaller current Iout, larger resistances of R1, R2 are necessary as indicated by Expression 28. In contrast, the sheet resistance of resistors formed on a semiconductor integrated circuit is 200 to 300Ω at the most. For this reason, the resistors will occupy almost of all the area of a BGR type reference current circuit having a total current value of 1 μA or lower, for example. This means that in order to realize a BGR type reference current circuit having a smaller area, the total resistance necessary for realizing the circuit must be further reduced.

Patent Document 1: Japanese Unexamined Patent Application Publication 11-45125 (FIG. 5 and the like)

DISCLOSURE OF THE INVENTION

Problems that the Invention is to Solve

In the conventional reference current circuit, however, a resistance of approximately 15 times the resistance R1 as a reference is necessary, as described above, and therefore, it is difficult to reduce the area of a semiconductor integrated circuit by remarkably reducing the total resistance.

In view of the foregoing, the present invention has its object of effortlessly reducing the area of a semiconductor integrated circuit by reducing the resistance necessary for a BGR type reference current circuit and the like.

Means for Solving the Problems

In order to solve the above problems, an embodiment in accordance with the present invention provides a reference current circuit includes: a current mirror circuit connected to a first power supply and generating first and second mirror currents at a predetermined current ratio, the first mirror current being distributed to first and second distributed currents while the second mirror current being distributed to third and fourth distributed currents; a first diode provided in a current path through which the first distributed current flows to a second power supply; a second diode provided in a current path through which the third distributed current flows to the second power supply; a first resistor provided in at least one of the current paths in which the first and third distributed currents flow; a second resistor provided in a current path in which an added current of the second and fourth distributed currents flows added and having one end connected to the second power supply; first to fourth transistors including drain electrodes on the first power supply side and source electrodes on the second power supply side of current paths in which the first to fourth distributed currents flow, respectively, wherein the first and third transistors control the first and third distributed currents to equalize a difference of potential differences between respective ends of the first and second diodes to a potential difference of ends of the first resistor, and the second and fourth transistors control a current ratio between the second and fourth distributed currents to be the predetermined current ratio.

With the above arrangement, the first and second mirror currents are kept at the predetermined current ratio by the current mirror circuit. The first mirror current is distributed to the first and second distributed currents while the second mirror current is distributed to the third and fourth distributed currents. The second and fourth distributed currents are kept at the predetermined current ratio by the second and fourth transistors. Herein, the terms, current distribution and addition are distinguished from each other according to the direction of the current flow for convenience in general and have the same meaning on the assumption that the positive and negative currents are symmetric.

Accordingly, the first and third distributed currents have the same current ratio. This means that the difference between the potential difference between the ends of the first diode in which the first distributed current flows and the potential difference between the ends of the second diode in which the third distributed current flows is in proportion to the absolute temperature. Further, the difference between the potential differences is controlled by the first and third transistors so as to be equal to the potential difference between the ends of the first resistor, and accordingly, the current flowing in the first resistor is in proportion to the absolute temperature and has a positive temperature coefficient.

On the other hand, the potential difference between the ends of the second resistor is approximately equal to the potential differences between the respective ends of the first and second diodes and has a negative temperature coefficient with respect to the absolute temperature. Therefore, the current flowing in the second resistor has a negative temperature coefficient with respect to the absolute temperature. Accordingly, appropriate setting of the resistances of the first and second resistors leads to offset of influence of the positive and negative temperature coefficients, so that variation caused due to the temperature variation of the mirror currents and the like can be suppressed or reduced in the first and second mirror currents before the second and fourth distributed currents are distributed.

Moreover, the second distributed current to which the first mirror current is distributed and the fourth distributed current to which the second mirror current is distributed are added and are allowed to flow into the second resistor. Accordingly, when the current ratio is 1:1, for example, required is only one resistor as the second resistor in which current of double flows, when compared with the case using two resistors in which the second and fourth distributed currents are allowed to flow individually. This means that the necessary resistance can be effortlessly reduced to one fourth.

Effects of the Invention

According to the present invention, the resistance necessary for a BGR type reference current circuit and the like can be reduced, thereby reducing the area of a semiconductor integrated circuit.

BRIEF DESCRIPTION OF THE DRAWINGS

FIG. 1 is a circuit diagram showing a configuration of a reference current circuit in accordance with Embodiment 1.

FIG. 15 is a circuit diagram showing a configuration of a conventional reference current circuit.

EXPLANATION OF REFERENCE NUMERALS

Figure 2:
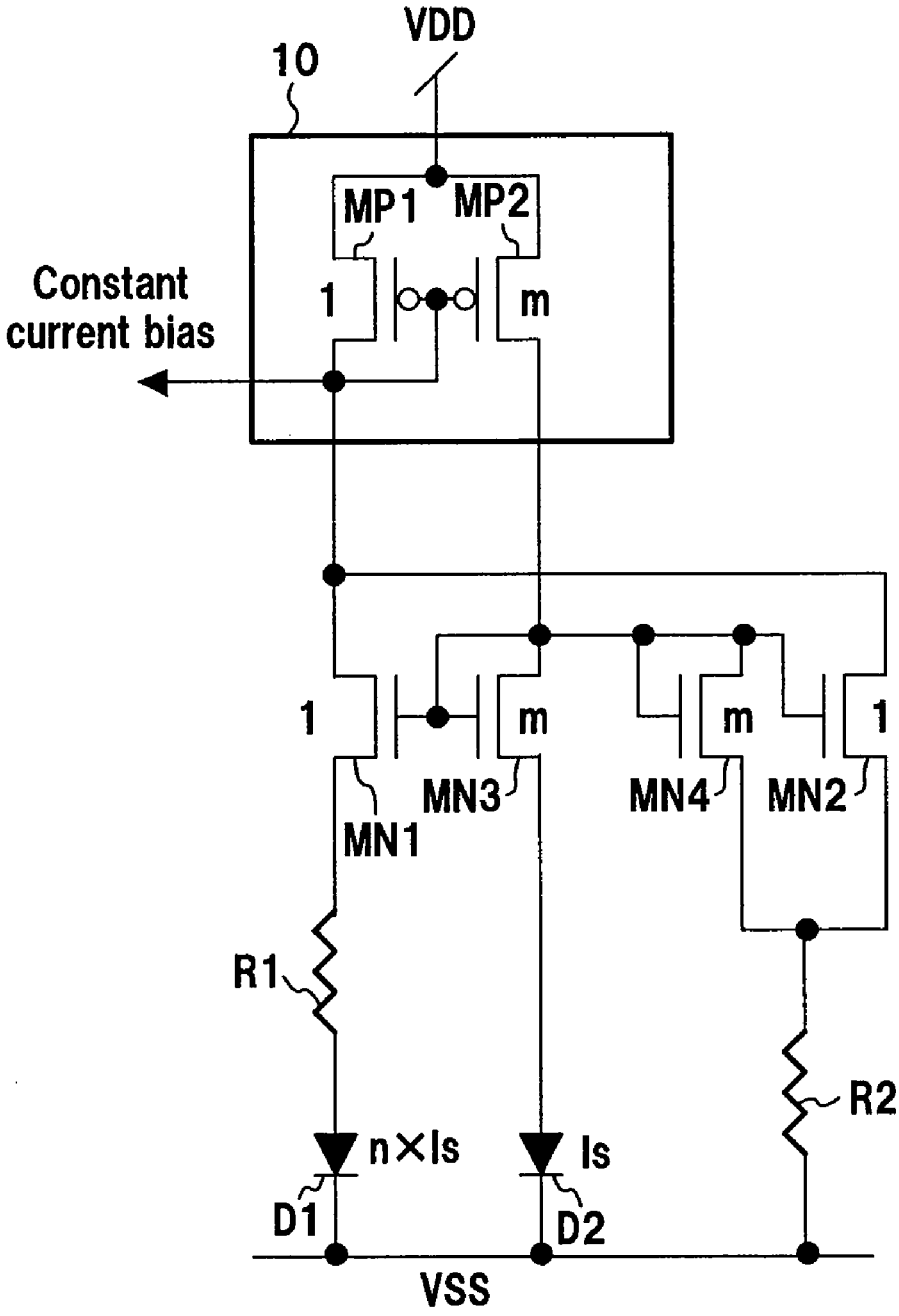
FIG. 2 is a circuit diagram showing a configuration of a current mirror circuit therein.

10, 11 current mirror circuit
20 operation amplifier
30 to 33 BGR circuit
40 control circuit
50 inverter power supply circuit
60 startup circuit
D1 to D3 diode
I1, I2 current
INV1 inverter circuit
R1 to R5 resistor
MN1 to MN5 nMOS transistor
MP1 to MP4 pMOS transistor
Vout0 abnormal state potential
Vout1 normal state potential

BEST MODE FOR CARRYING OUT THE INVENTION

Embodiments of the present invention will be described below in detail with reference to the accompanying drawings. In each of the following embodiments, the same reference numerals are assigned to elements having the same functions as in the other embodiments for omitting the description thereof.

Embodiment 1 of the Invention

A reference current circuit of Embodiment 1 includes, as shown in FIG. 1, a current mirror circuit 10, two diodes (D1, D2), two resistors (R1, R2), and four nMOS transistors (MN1 to MN4). The current mirror circuit 10 is composed of pMOS transistors MP1, MP2, as shown in FIG. 2.

The gate electrodes of the pMOS transistors MP1, MP2 and the drain electrode of the pMOS transistor MP1 are connected to one another, and the potential of the electrodes is output as constant current bias. Further, they are formed to have a current ratio (a transistor size ratio) of 1:m, where m is a real number or an integer equal to or larger than 1, for example. A more specific approach is that the gate lengths thereof are set equal to each other while the gate width of one of them is set m times that of the other, for example. This achieves control of one of output currents to be output at the current ratio of 1:m (Iout:m·Iout) according to the other output current Iout when both the pMOS transistors MP1, MP2 operate in the saturation region, for example.

Furthermore, the nMOS transistors MN1, MN3 and the nMOS transistors MN2, MN4 are so formed respectively to have a transistor size ratio of 1:m. The gate electrodes of the nMOS transistors MN1 to MN4 are connected to one another and are connected to the drain electrode of the nMOS transistor MN3. There is no specific limitation on the ratio between the currents flowing in or the transistor size of the nMOS transistors MN1, MN3 and the currents flowing in or the transistor size of the nMOS transistors MN2, MN4. In other words, the ratio of the currents flowing in the nMOS transistors MN1, MN3, MN2, and MN4 may be 1:m:α:mα where α is an arbitrary constant, for example.

The two diodes (D1, D2) is so set that the ratio of the reverse saturation currents (diode size ratio) becomes n:1, where n is a real number or an integer larger than 1, for example. The resistances of the resistors R1, R2 are set so as to suppress or reduce variation of the current Iout caused due to the temperature variation, which will be described later.

In the thus configured reference current circuit, the ratio of the currents output from the current mirror circuit 10, that is, the ratio between the sum of the currents flowing in the nMOS transistors MN1, MN2 and the sum of the currents flowing in the nMOS transistors MN3, MN4 is 1:m (Iout:m·Iout), as above.

In addition, the nMOS transistors MN2, MN4 have a transistor size ratio of 1:m and have gate potentials equal to each other and source potentials equal to each other, which means that the ratio of the currents flowing in the nMOS transistors MN2, MN4 is 1:m (I2:m·I2).

Accordingly, each current Iout and m·Iout from the current mirror circuit 10 is distributed so that the ratio of the currents flowing in the nMOS transistors MN1, MN3 (and the diodes D1, D2) becomes 1:m (I1:m·I1). In this case, also, the transistor size ratio of the nMOS transistors MN1, MN3 is 1:m and the gate potentials thereof are equal to each other, which means that the source potentials thereof are equal to each other, Vd.

On the other hand, the relationship between the current I1 flowing in the diode D1 and the anode potential V1 is expressed by Expression 1 indicated in combination in FIG. 1. The current flowing in the diode D2 is m times the current I1, as described above, and accordingly, the relationship between the current I1 and the anode potential Vd of the diode D2 is expressed by Expression 2. Wherein, Is is a reverse saturation current of the diode D2, n is a ratio between the reverse saturation currents of the diodes D1, D2, k is a Boltzmann constant, T is an absolute temperature, and q is an electron charge.

The source potentials of the nMOS transistors MN1, MN3 are each Vd, and therefore, the voltage across the resistor R1 is equal to the voltage difference between the voltages across the diodes D1, D2. Further, the current I1 flowing in the resistor R1 is equal to a value obtained by dividing this voltage difference by the resistance of the resistor R1 (Expression 3 and Expression 4).

If the mutual conductance of the nMOS transistors MN2, MN4 is sufficiently large, the source potentials thereof can be deemed to Vd, the same as those of the nMOS transistors MN1, MN3, and accordingly, the current (sum of I2 and m·I2) flowing in the resistor R2 is Vd/R2. This leads to Expression 5 for the drain current I2 of the nMOS transistor MN2, and therefore, the current Iout flowing in the pMOS transistor MP1 can be obtained by addition of Expressions 4 and 5 (Expression 6). With no VDD depending term in Expression 6, an ideal element causes no variation of the current Iout caused due to the power supply voltage variation.

The temperature coefficient of the current Iout with respect to the absolute temperature can be obtained by partially differentiating Expression 6 by the absolute temperature T (Expression 7). In Expression 7, the first term is a positive value of a coefficient with respect to the absolute temperature T while the gradient (∂Vd/∂T) of Vd with respect to the absolute temperature in the second term is a negative value. Accordingly, when the values of R1, R2, m, and n are set so that the value of Expression 7 as the temperature coefficient of the current Iout becomes zero, the current Iout and the like become independent from temperature.

Specifically, given that the value A is defined by Expression 8, the resistor R2 is set by Expression 9 with respect to the resistor R1.

Figure 3:
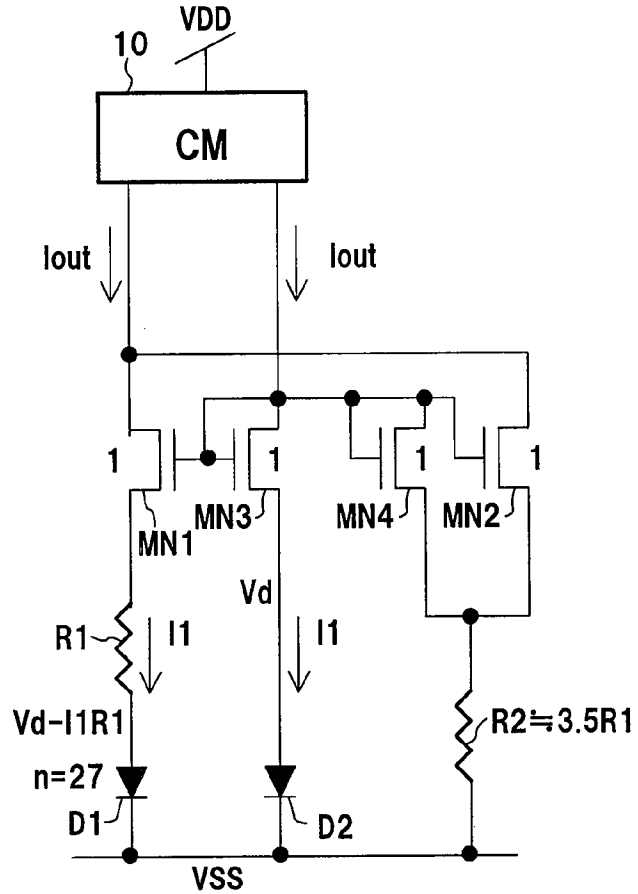
FIG. 3 is an explanatory drawing showing a necessary resistance therein.

The total resistance Rall necessary for forming the above reference current circuit is the sum of R1 and R2, namely, is expressed by Expression 10 in FIG. 3. Though the value m is not limited specifically, the current ratio of the currents flowing in the pMOS transistors MP1, MP2 is preferably set at 1:1 (m=1) for minimizing the total current value. Further, as the Boltzmann constant k=1.38E−23 and the electron charge amount q=1.6E−19, n=27 and ∂Vd/∂T=−2 mV/K lead to A≈7 (Expression 11).

Accordingly, R2≈3.5·R1 (Expression 12) and the total resistance Rall≈4.5·R1 (Expression 13) are lead, and accordingly, the total resistance can be suppressed to approximately 4.5 time the resistance of R1 as a reference resistance.

Figure 16:
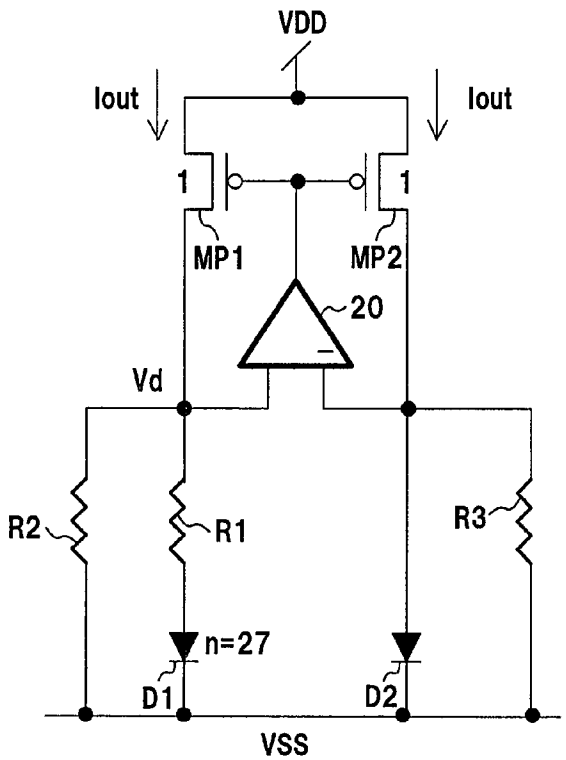
FIG. 16 PRIOR ART
FIG. 16 is an explanatory drawing showing a necessary resistance therein.

In other words, when the resistance of the resistor R1 is set equal to that of the circuit shown in FIG. 16 for configuring a BGR type reference current circuit generating the same currents (herein, the current that the operation amplifier in FIG. 16 consumes is deemed to be zero), the necessary total resistance Rall is approximately 15 times the resistance of R1 in the circuit shown in FIG. 16, as described above, while being only approximately 4.5 times that in Embodiment 1. This means one third or more reduction of the total resistance Rall. More specifically, two resistors R2, R3 in which the current I2 flows are provided in FIG. 16 while only one resistor R2 in which the current of double, 2·I2 flows is required in Embodiment 1, which means that the resistance of only one fourth in total is required in the resistors other than resistor R1.

The resistors dominantly occupies the circuit area specifically in a BGR type reference current circuit consuming extremely small current and the like, and therefore, the area of the semiconductor integrated circuit can be reduced effortlessly and remarkably.

Although the above example refers to the case where the nMOS transistors MN1 to MN4 and the pMOS transistors MP1, MP2 are provided, the present invention is not limited thereto and may use a current mirror circuit configuration in a cascade structure for suppressing current variation caused due to drain voltage variation small, for example.

Referring to the connection order of the resistor R1 and the diode D1, the diode D1 is usually provided on the VSS side in general in view of the semiconductor process technology. Even when the order is reversed, however, the same effects can be obtained, namely, the temperature dependency can be suppressed or reduced with a small total resistance Rall.

Further, the temperature dependency may not necessarily be suppressed completely, and constants and the like may be set so as to obtain characteristics according to the accuracy and the specification required in a device.

The values of m and n are usually set to integers but is not limited thereto. The values may be set to real numbers other than integers.

The constant current bias outputting method is not limited to the aforementioned one as far as the currents in proportion to I1+I2 are current-mirrored.

Embodiment 2 of the Invention

Figure 4:
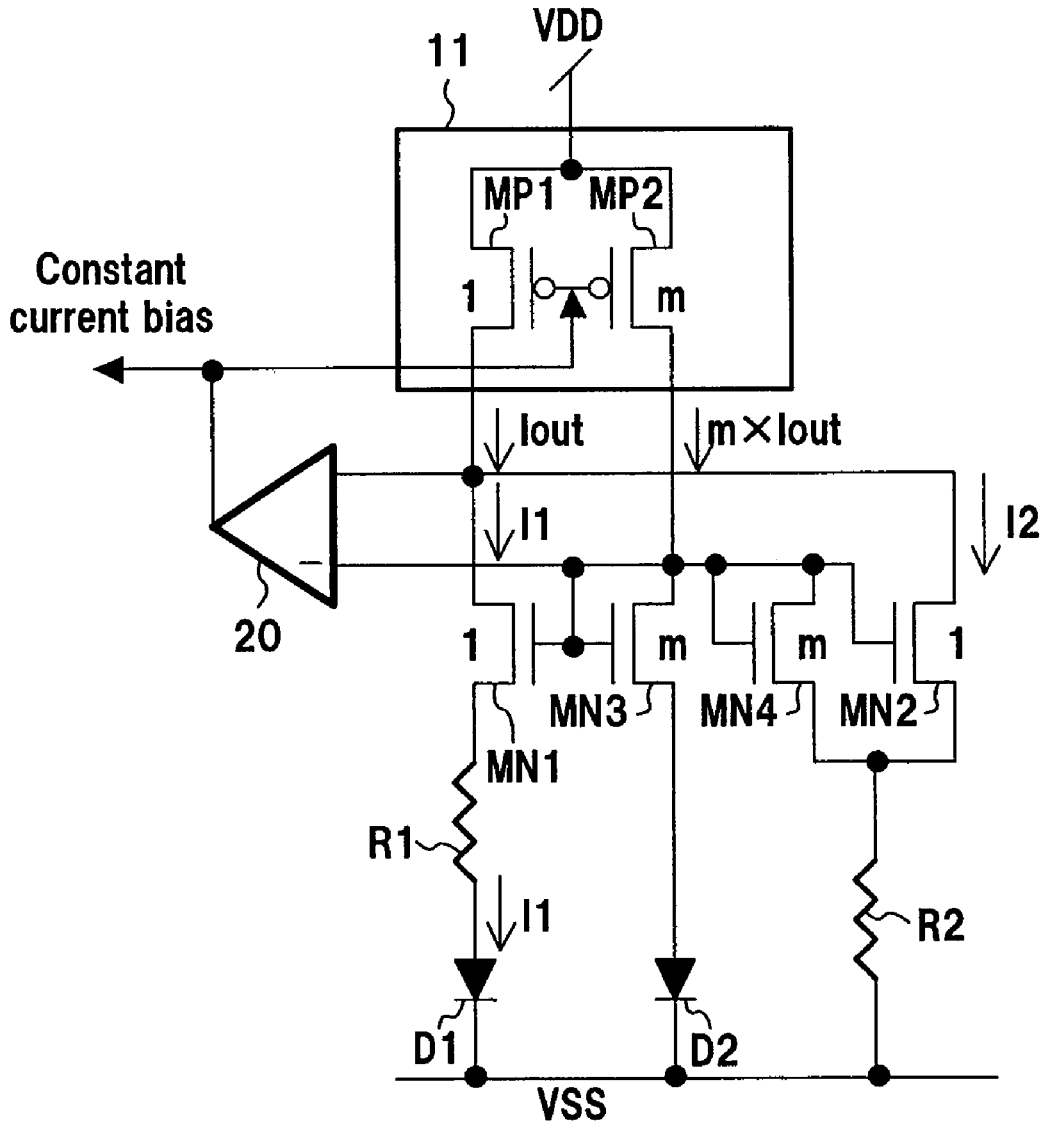
FIG. 4 is a circuit diagram showing a configuration of a reference current circuit in accordance with Embodiment 2.

A reference current circuit of Embodiment 2 includes, as shown in FIG. 4, a current mirror circuit 11, in lieu of the current mirror circuit 10, and an operation amplifier 20 in addition when compared with the reference current circuit of Embodiment 1 (FIG. 1 and FIG. 2).

The current mirror circuit 11 is different from that in Embodiment 1 in that the gate electrodes of the pMOS transistors MP1, MP2 connected to each other are connected to the output terminal of the operation amplifier 20 rather than the drain electrode of the pMOS transistor MP1.

The operation amplifier 20 keeps the current ratio of the output currents of the pMOS transistors MP1, MP2 at 1:m by feedback-controlling the drain potentials thereof to be equal to each other.

The thus configured reference current circuit has the same mechanism as in Embodiment 1 that the temperature dependency of the current Iout and the like are suppressed or reduced by controlling the currents Iout, m·Iout output from the current mirror circuit 11, the currents I1, I2, m·I1, and m·I2 of the respective parts, the potential Vd, and the like and the same mechanism as in Embodiment 1 that the total resistance Rall can be reduced effortlessly by allowing the currents flowing in the nMOS transistors MN2, MN4 to be added and flow into the resistor R2.

Further, when the operation amplifier 20 controls the pMOS transistors MP1, MP2 to have drain potentials equal to each other, the current can be distributed at a current ratio of 1:m when MP1 and MP2 operate even in the linear region as well as in the saturation region. In consequence, operation with further lower power supply voltage VDD can be achieved effortlessly when compared with Embodiment 1 (FIG. 1 to FIG. 3).

Embodiment 3 of the Invention

Figure 5:
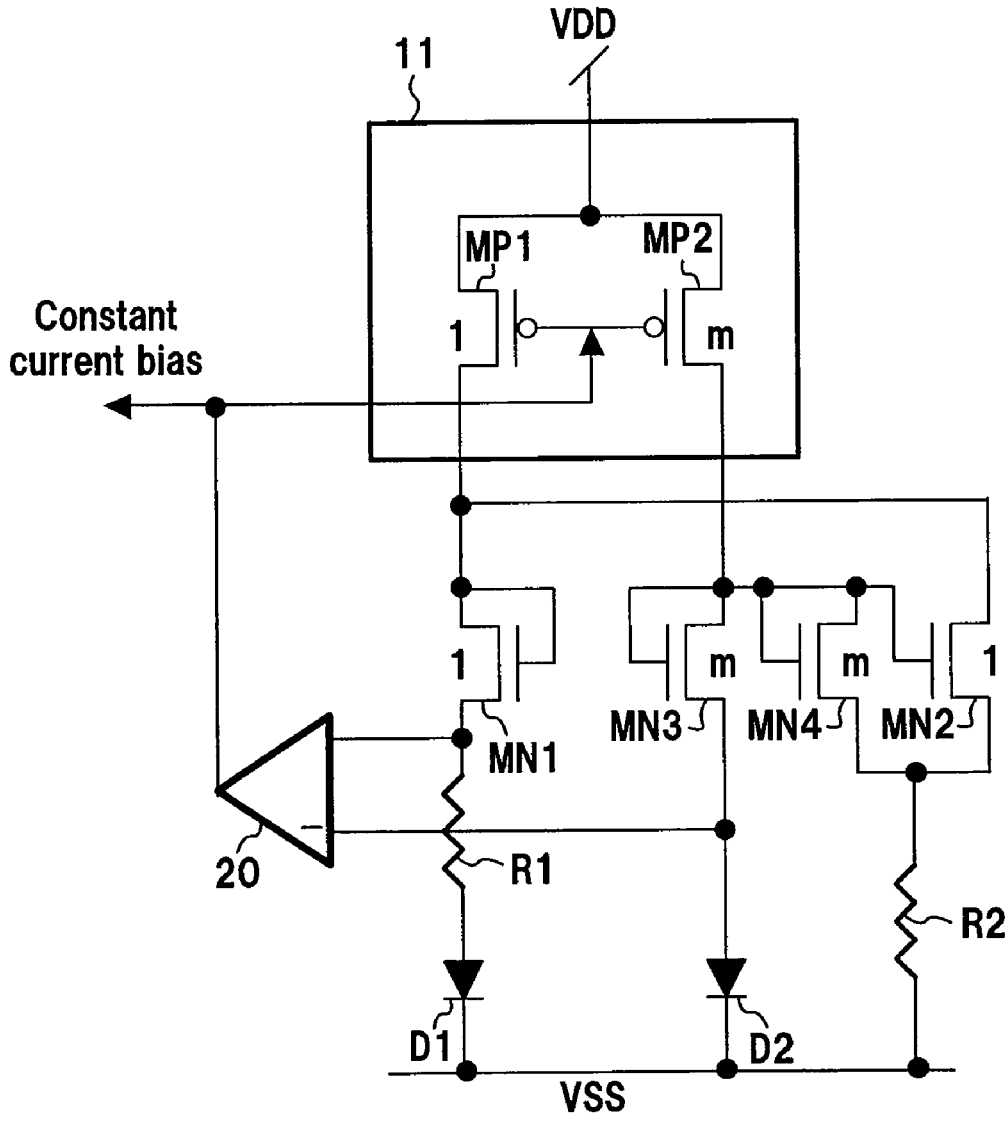
FIG. 5 is a circuit diagram showing a configuration of a reference current circuit in accordance with Embodiment 3.

A reference current circuit of Embodiment 3 has, as that shown in FIG. 5, a similar configuration to that in FIG. 4, wherein the operation amplifier 20 feedback-controls the gate potential of the pMOS transistors MP1, MP2 to keep the current ratio of the output currents at 1:m so that the source potentials of the nMOS transistors MN1, MN3 are equal to each other.

The gate electrode of the nMOS transistor MN1 is connected to the drain electrode of itself rather than the gate electrode of the nMOS transistor MN3 to prevent the drain potential of the pMOS transistor MP1 from being unstable.

The thus configured reference current circuit is different from those of Embodiments 1 and 2 in that the operation amplifier 20 performs feedback control for equalizing the potentials Vd of the source electrodes of the nMOS transistors MN1, MN3 to each other. The resultant mechanism that the temperature dependency of the current Iout and the like are suppressed or reduced and the like are the same as those in Embodiments 1 and 2. The control by the operation amplifier 20 on the gate potential of the pMOS transistors MP1, MP2 effortlessly allows the reference current circuit to operate with further lower power supply voltage VDD when compared with that in Embodiment 1 (FIG. 1 to FIG. 3), which is the same as in Embodiment 2.

The gate electrode of the nMOS transistor MN2 may be connected to the gate electrode of MN1 rather than the gate electrodes of the nMOS transistors MN3, MN4 in common.

Embodiment 4 of the Invention

Figure 6:
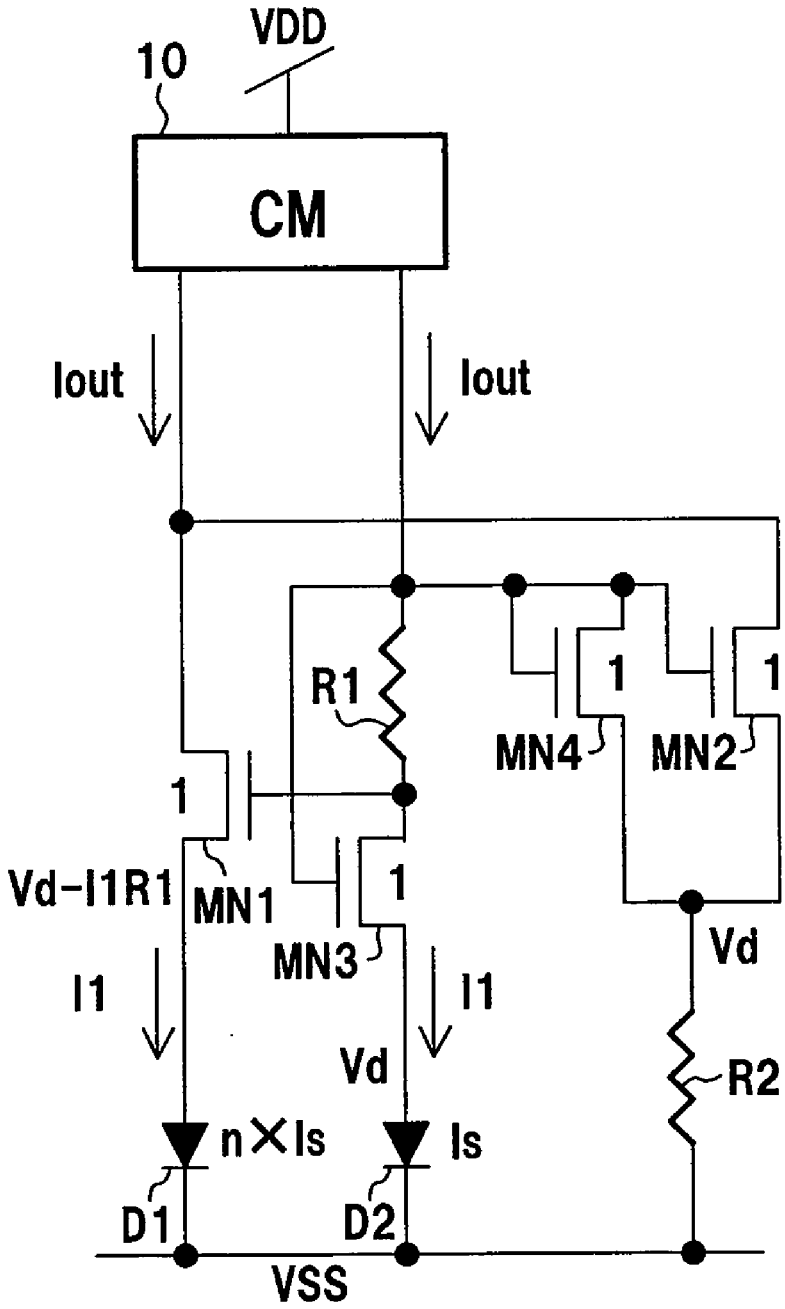
FIG. 6 is a circuit diagram showing a configuration of a reference current circuit in accordance with Embodiment 4.

In order to equalize the difference between voltages across the diodes D1, D2 to the voltage across the resistor R1, the difference in the gate potentials of the nMOS transistors MN1, MN3 and the difference in the source potentials thereof may be set equal to each other rather than setting of the respective potentials and the respective source potentials thereof equal to each other. Specifically, as shown in FIG. 6, for example, the resistor R1 is connected on the drain side of the nMOS transistor MN3, the gate electrode of the nMOS transistor MN1 is connected to one end on the VSS side of the resistor R1, and the gate electrodes of the nMOS transistors MN2 to MN4 are connected to the other end on the power supply voltage VDD side of the resistor R1.

In this case, the currents flowing in the nMOS transistors MN1, MN3 become equal to each other, I1, as in Embodiment 1. While on the other hand, the gate potential of the nMOS transistor MN1 is I1 R1 lower than the gate potential of the nMOS transistor MN3. When the source potential of the nMOS transistor MN3 is Vd, the source potential of the nMOS transistor MN1 is Vd−I1·R1 and the voltage difference between voltages across of the diodes D1, D2 is equal to the voltage across the resistor R1.

In consequence, when both the nMOS transistors MN1, MN3 operate in the saturation region and the body effect of the nMOS transistors MN1, MN3 is small enough to be ignored, the expressions for obtaining the current Iout and the total resistance Rall are the same as those indicated in FIG. 1 and FIG. 3 (Expression 1 to Expression 13) in Embodiment 1. Accordingly, the mechanism that the temperature dependency of the current I1 and the like are suppressed or reduced, the mechanism that the total resistance Rall can be reduced effortlessly, and the like are the same as those in Embodiment 1.

Figure 7:
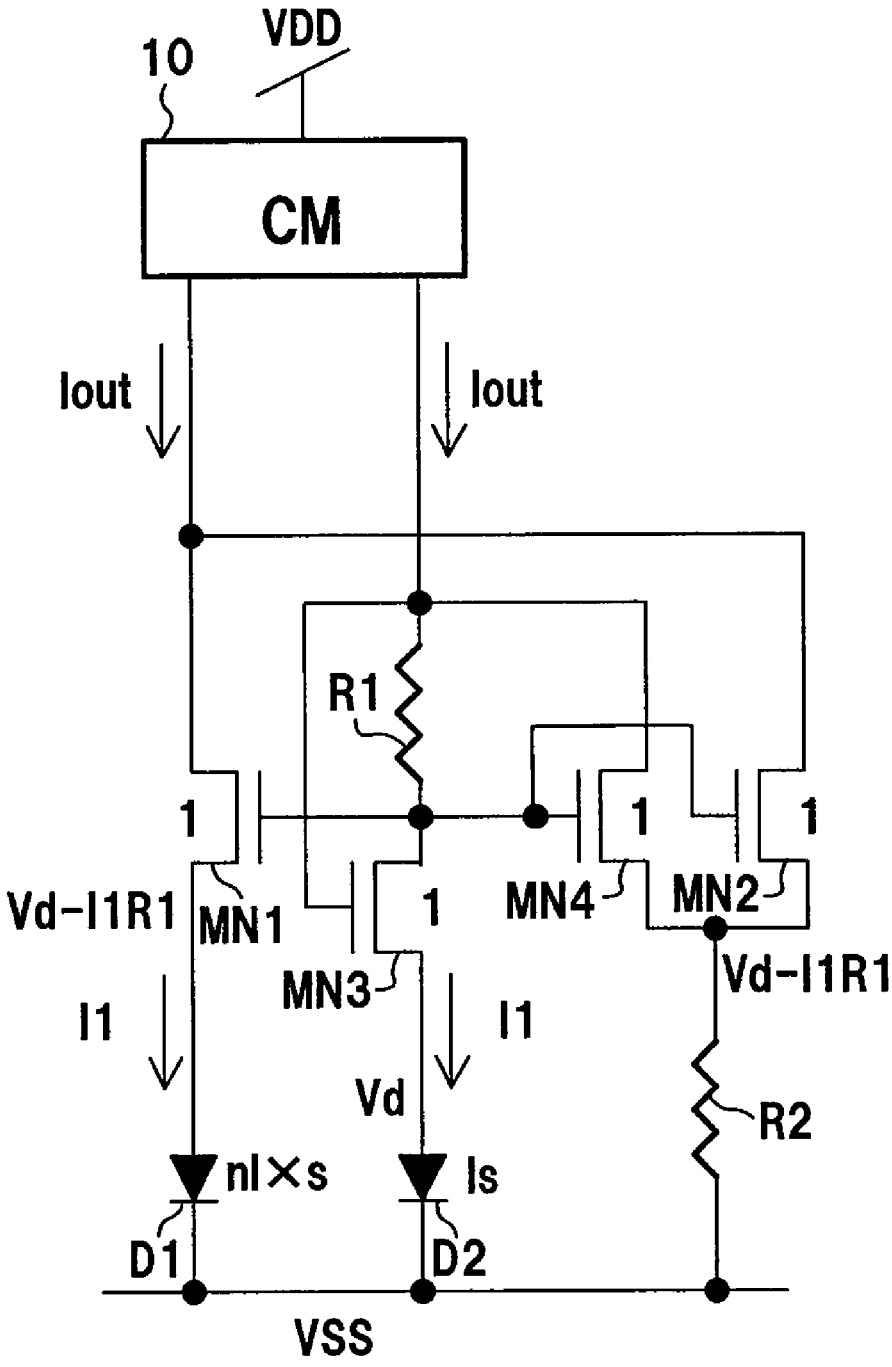
FIG. 7 is a circuit diagram showing a configuration of a reference current circuit in accordance with a modified example therein.

The gate electrodes of the nMOS transistors MN2, MN4 may be connected to the gate electrode of the nMOS transistor MN1, as shown FIG. 7, rather than to the gate electrode of the nMOS transistor MN3. There are two different points in operation in this arrangement from that in FIG. 6. Namely, the voltage applied to the ends of the resistor R2 is Vd in FIG. 6 while that is Vd−I1R1 in FIG. 7. Second, the temperature coefficient (∂Vd/∂T) of the voltage at the ends of a diode in Expression 7 is directed to the diode D2 in FIG. 6 while that is directed to the diode D1 in FIG. 7. Herein, the current density of the diode D1 is smaller than that of the diode D2, and accordingly, operation that the absolute value of ∂Vd/∂T of the diode D1 is slightly larger than that of the diode D2 is offset by operation that the voltage applied to the ends of the resistor R2 is slightly lowered. Accordingly, when the resistance of the resistor R2 is set in accordance with Expression 7, the temperature dependency of the current Iout and the like in the configuration shown in FIG. 7 can be suppressed or reduced in practice.

The configuration in FIG. 1 may be combined with the configuration in FIG. 6 or FIG. 7. Specifically, in the case where m=1, for example, when two resistors are provided at the point of the resistor R1 in FIG. 1 and the point of the resistor R1 in FIG. 6 or FIG. 7 and the total resistance of the two resistors is set equal to that of the resistor R1 in FIG. 1 and FIG. 6 or FIG. 7, the difference between the voltages across the diodes D1, D2 becomes equal to the sum of the voltages across the two resistors, which leads to attainment of the same effects.

In addition, the above example refers to the case where m=1 (the current ratio is 1:1), but m may be larger than 1 (m>1). In this case, the resistance on the drain side of MN3 can be reduced to 1/m.

Embodiment 5 of the Invention

In each of the above embodiments, the gate potential of the pMOS transistors MP1, MP2 composing the current mirror circuit 10, 11 are output as constant current bias, but the present invention is not limited thereto as far as a current in proportion to the current Iout output from the current mirror circuit 10, 11 can be obtained. For example, as shown in FIG. 8, a pMOS transistor MP3 (MOS diode) of which gate electrode and the drain electrode are connected to each other is provided between the power supply (VDD) and the pMOS transistors MP1, MP2 so that the potential of the gate electrode thereof is output as the constant current bias.

Figure 8:
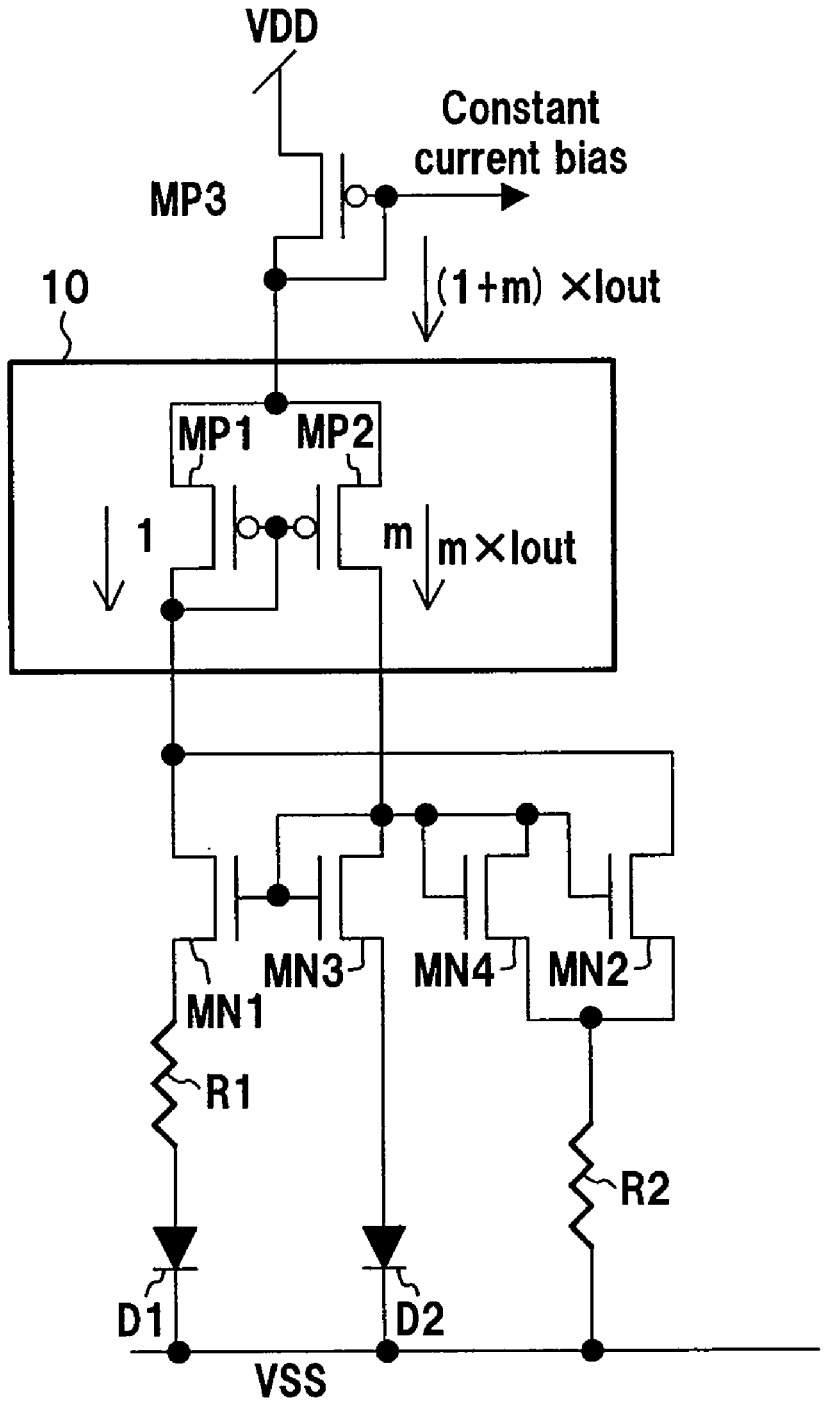
FIG. 8 is a circuit diagram showing a configuration of a reference current circuit in accordance with Embodiment 5.

In the example shown in FIG. 8, the current ratio of the current mirror circuit 10 is 1:m, and accordingly, the total current (1+m)·Iout flows in the pMOS diode MP3. In the case where this pMOS transistor MP3 is provided, the operable range of the power supply voltage VDD is narrowed. However, when the power supply voltage VDD is high to some degree (VDD>about 2.5V or so), for example, variation in the output constant current bias can be suppressed small effortlessly relative to relative characteristic variation of the pMOS transistors MP1, MP2 and the nMOS transistors MN1 to MN4.

The configuration provided with the above pMOS transistor MP3 is applicable not only to the configuration as in FIG. 2 but also to any of the configurations shown in FIG. 4 to FIG. 7 and FIG. 15 and various modifications thereof.

Embodiment 6 of the Invention

Figure 9:
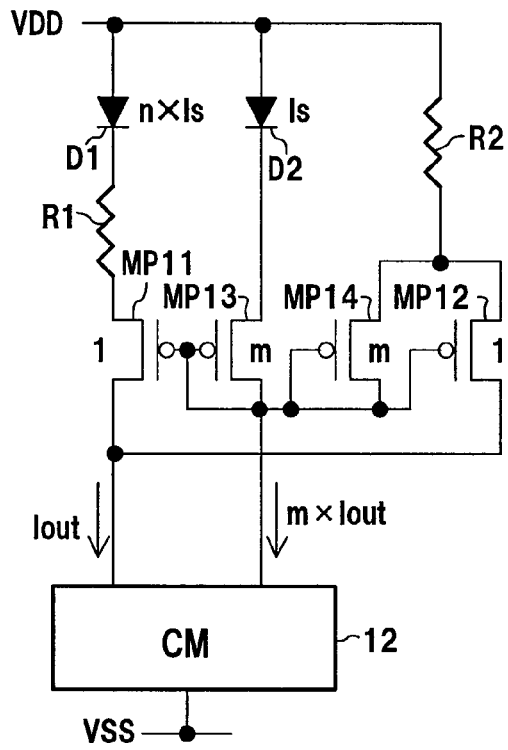
FIG. 9 is a circuit diagram showing a configuration of a reference current circuit in accordance with Embodiment 6.

In the above description, the current mirror circuit 10, 11 is connected to the high-potential power supply (VDD). In reverse, each polarity of the nMOS transistors and the pMOS transistors and each polarity of the anodes and the cathodes of the diodes D1, D2 may be reversed with the high-potential power supply (VDD) replaced by the low-potential power supply (VSS), as shown in FIG. 9, for example. This attains symmetric operation, thereby attaining the same operation and effects as the above description. This can be applied to any of the configurations shown in FIG. 4 to FIG. 8 and various modifications thereof.

Embodiment 7 of the Invention

Figure 10:
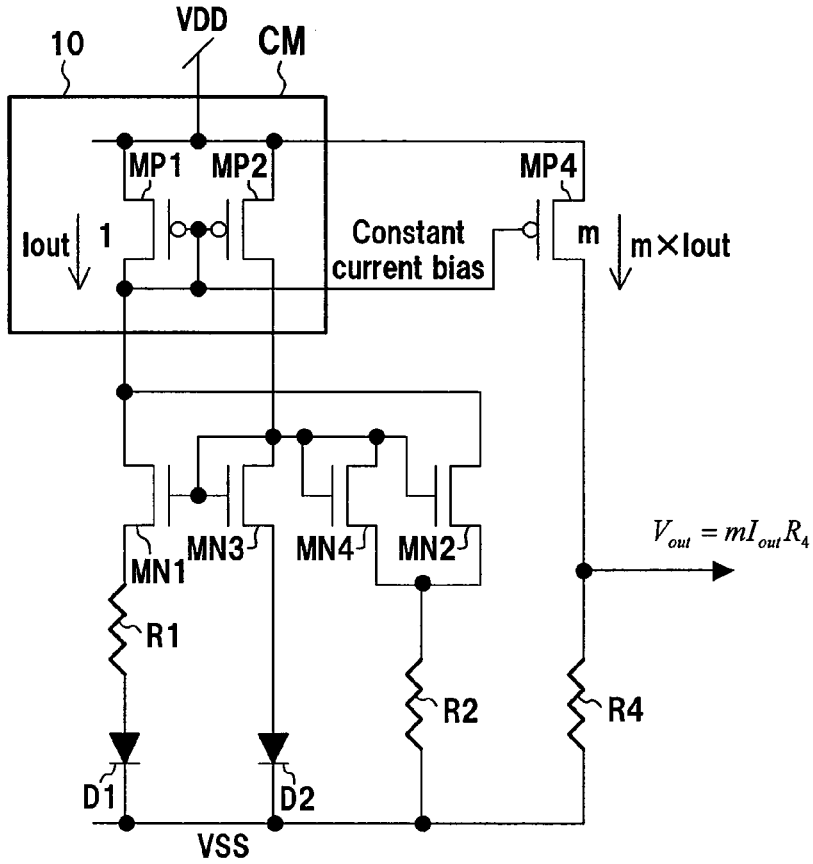
FIG. 10 is a circuit diagram showing a configuration of a reference current circuit in accordance with Embodiment 7.

A reference voltage circuit utilizing constant current bias may be configured by using any of various BGR type reference current circuits causing less (or no) influence of the temperature variation and the power supply voltage variation as above. For example, as shown in FIG. 10, when there are provided a pMOS transistor MP4 current-mirroring the current Iout by m times and a resistor R4 of which one end is connected to the drain electrode of the pMOS transistor MP4 and of which other end is connected to the power supply VSS, a reference voltage Vout=m·Iout·R4, which is conversion of the current Iout as a reference current into a voltage, can be obtained.

In other words, when a resistor having sufficiently small temperature variation relative to the necessary accuracy is used, a small reference voltage Vout having less influence of the temperature variation and the power supply voltage variation can be generated effortlessly. The configuration for obtaining this reference voltage is applicable to any of the configurations shown in FIG. 4 to FIG. 9 and various modifications thereof.

Embodiment 8 of the Invention

A BGR circuit applied to any of the above reference current circuits and the above reference voltage circuits involves a bi-stable problem intrinsically and necessitates, therefore, a startup circuits in general. The bi-stable problem is a problem that an abnormal stable operation state is present besides a normal stable operation state and the circuit once falling in the abnormal stable state cannot be automatically reset to the normal stable state.

Specifically, in the reference current circuit (FIG. 2) of Embodiment 1, for example, when the gate potential of the pMOS transistor MP1 is VDD and the gate potential of the nMOS transistor MN3 is VSS, the reference current circuit is maintained in this state as an abnormal stable state.

To tackle this problem, a startup circuit is used in general for avoiding the abnormal stable state at operation start of a BGR circuit. Specifically, the abnormal stable state is transferred to the normal stable state by lowering the gate potential of the pMOS transistor(s) MP1 (and MP2) or raising the gate potential(s) of the nMOS transistor(s) MN3 (and MN1) by applying a predetermined initializing pulse.

The above startup circuit, however, necessitates a special initialization control signal indicating operation start of the BGR circuit, and therefore, the BGR circuit is liable to have less flexibility. Further, in the case where some trigger once causes the abnormal stable state in the normal stable operation state, the above startup circuit cannot reset the circuit to the normal stable operation state gain.

A startup circuit will be described below which does not necessitate the above special initialization control signal and the like and can reset a circuit to the stable state at any time.

Figure 11:
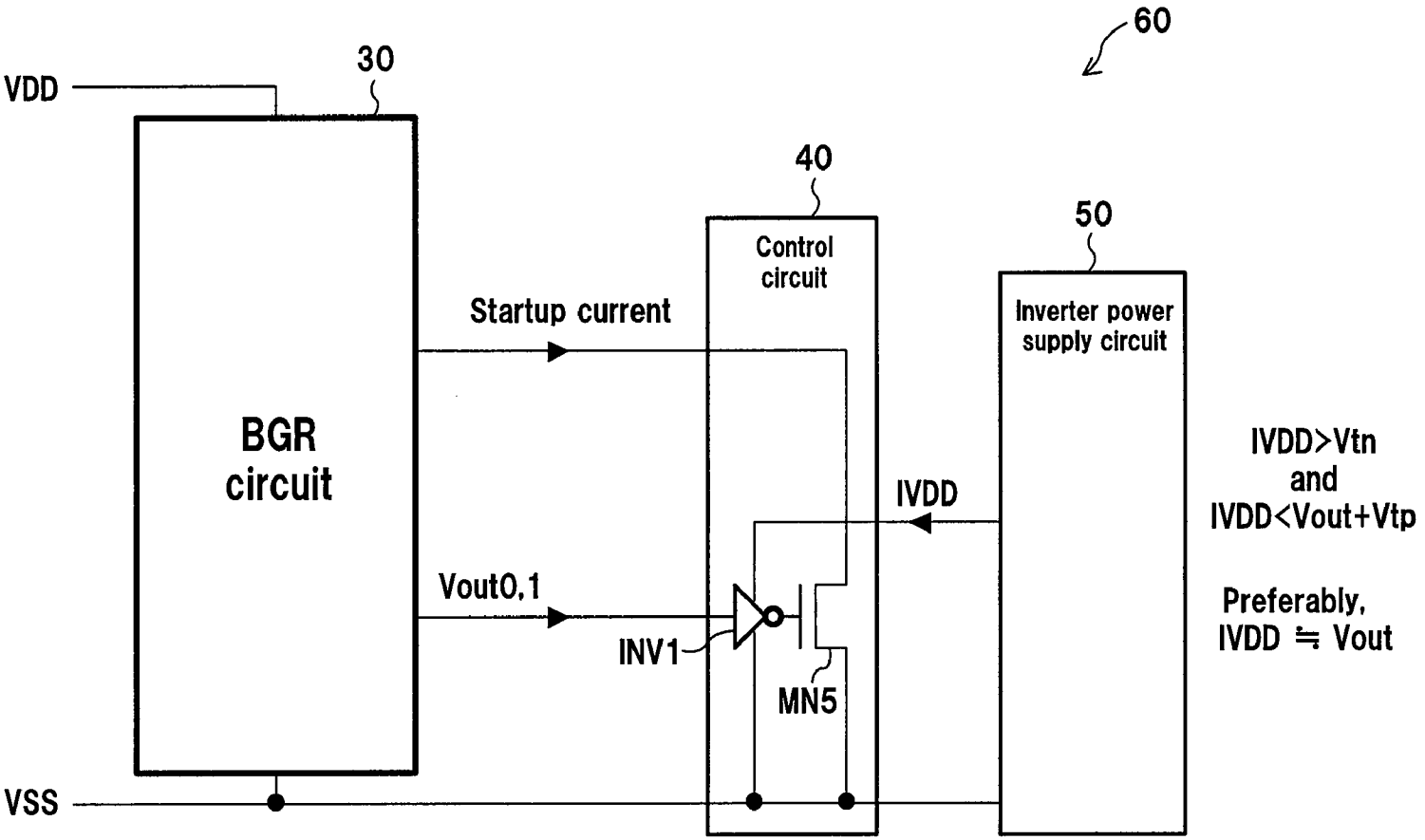
FIG. 11 is a circuit diagram showing a schematic configuration and an operation principle of a startup circuit in accordance with Embodiment 8.

FIG. 11 is a circuit diagram showing a schematic configuration and an operation principle of a startup circuit 60.

A BGR circuit 30 for the startup circuit 60 includes a state potential output node and a startup control node as follows. Namely, the state potential output node outputs an abnormal state potential Vout0 (for example, Vout0≈VSS) in the abnormal stable state while outputting a normal state potential Vout1 (for example, Vout1 is a voltage higher than the threshold voltage of the inverter circuit INV1) in the normal stable state. On the other hand, the startup control node is capable of resetting the BGR circuit 30 to the normal stable state by being connected to the power supply VSS or the like for allowing a startup current to flow.

The startup circuit 60 includes a control circuit 40 and an inverter power supply circuit 50.

The control circuit 40 includes an inverter circuit INV1 composed of a pMOS transistor and an nMOS transistor (both not shown) and an nMOS transistor MN5 ON/OFF switched according to the output of the inverter circuit INV1. The control circuit 40 connects the startup control node to the power supply VSS when the abnormal state potential Vout0 is output from the BGR circuit 30.

The inverter power supply circuit 50 outputs an inverter power supply voltage IVDD for the inverter circuit INV1. The inverter power supply voltage IVDD is set equal to or larger than the threshold voltage Vtn of the nMOS transistor MN5 (IVDD≧Vtn) and equal to or lower than the voltage obtained by adding the threshold voltage Vtp of the pMOS transistor (not shown) in the inverter INV1 to the normal state potential Vout1 output from the BGR circuit 30 (IVDD≦Vout1+Vtp). The inverter power supply voltage IVDD is preferably set within the range of Vout1±0.2 V, more preferably, set nearly equal to Vout1 (IVDD≈Vout1).

With the above arrangement, the abnormal state potential Vout0 (Vout0≈Vss) is output when the BGR circuit 30 falls in the abnormal state, so that the pMOS transistor and the nMOS transistor in the inverter circuit INV1 are turned ON and OFF, respectively, to allow the inverter circuit INV1 to output the supplied inverter power supply voltage IVDD directly. The inverter power supply voltage IVDD is set equal to or larger than Vtn (IVDD≧Vtn) as described above, for example, and accordingly, the nMOS transistor MN5 is turned ON. This allows the startup current to flow from the startup control node to the power supply VSS to reset the BGR circuit 30 to the normal stable state.

In contrast, in the normal state, the BGR circuit 30 outputs the normal state potential Vout1 (a voltage higher than the threshold voltage of the inverter circuit INV1), so that the output potential of the inverter circuit INV1 is VSS to turn the nMOS transistor MN5 OFF. Therefore, the startup circuit 60 does not affect the normal operation of the BGR circuit 30. When the inverter power supply voltage IVDD is set as above, namely, IVDD≦Vout1+Vtp (or IVDD≈Vout1 or so), for example, the pMOS transistor in the inverter circuit INV1 is turned OFF, which definitely prevents through current of the inverter circuit INV1, thereby inviting no increase in current consumption.

Figure 12:
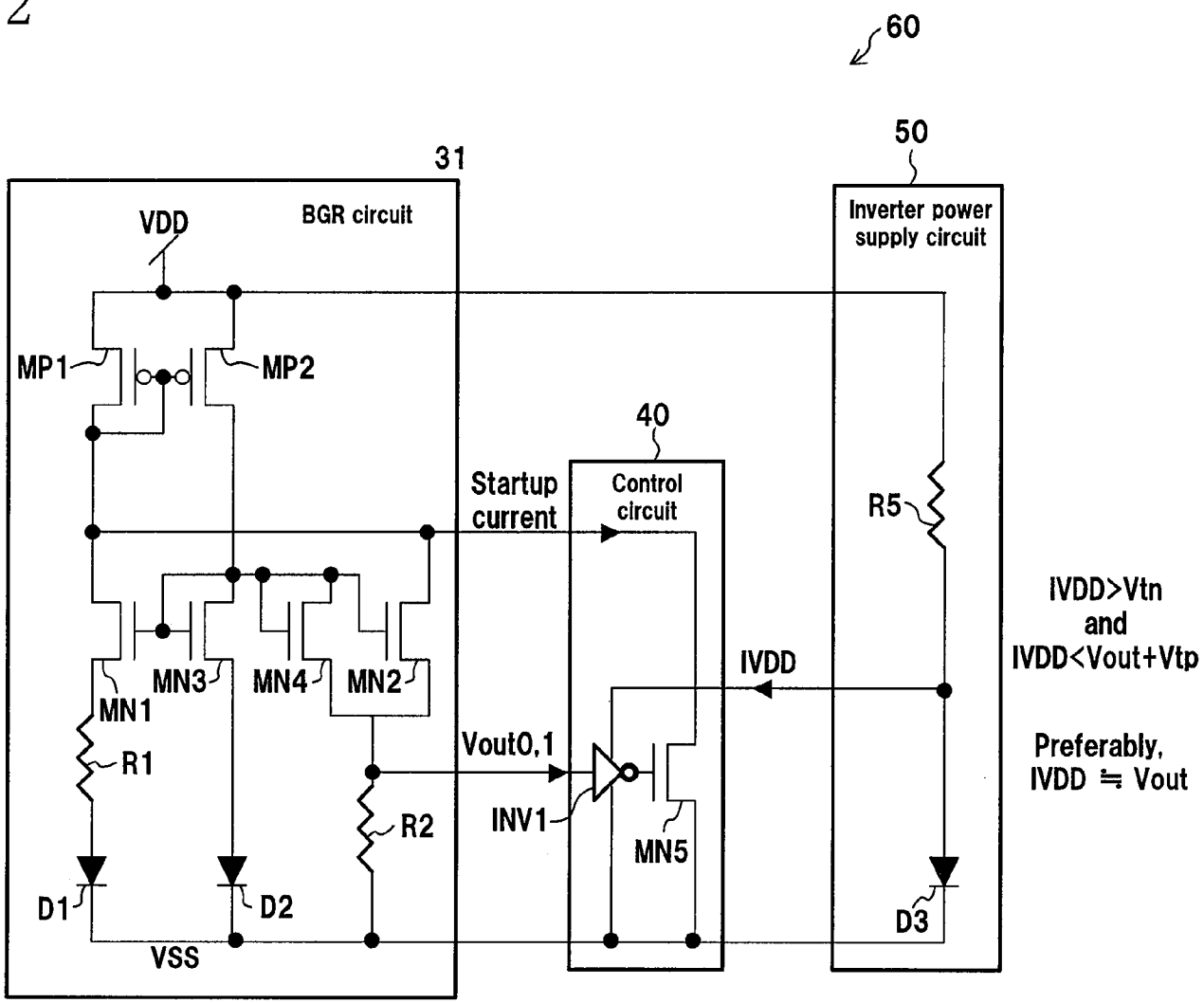
FIG. 12 is a circuit diagram showing a concrete example where the startup circuit is applied to a BGR circuit therein.

A BGR circuit to which the above startup circuit is applicable may be the reference current circuit described in Embodiment 1 (FIG. 2), as indicated as a BGR circuit 31 shown in FIG. 12, for example. In this case, for example, the source electrodes of the nMOS transistors MN2, MN4 are connected to the state potential output node. Further, the gate electrode of the pMOS transistors MP1, MP2 is connected to the startup control node.

In the above case, the inverter power supply circuit 50 may divide the voltage between the power supplies VDD and VSS to a resistor R5 and a diode D3, for example, to output the inverter power supply voltage IVDD. The power supply voltage IVDD is a forward voltage of the diode D3 and the normal state potential Vout1 is nearly equal to the forward voltage Vd of the diode D2. This means that the power supply voltage IVDD is set nearly equal to Vd (IVDD≈Vd), as described above. Further, since the threshold voltage of the nMOS transistor MN5 is generally lower than the forward voltage of a diode, the condition that IVDD≧Vtn is satisfied.

In consequence, the abnormal state potential Vout0 (Vout0≈VSS) is output from the state potential output node in the abnormal stable state to turn the nMOS transistor MN5 ON, as described above, thereby allowing the startup current to flow. This causes the gate potential of the pMOS transistors MP1, MP2 to be VSS to allow the current to flow through MP2. When the gate potential of the nMOS transistor MN3 increases according thereto to cause the current to flow through the resistor R2, the potential of Vout increases to reset the BGR circuit 31 to the normal stable state.

While in the normal stable state, the normal state potential Vout1 (Vout1≈Vd) is output to turn the nMOS transistor MN5 OFF, as described above, causing no influence on the BGR circuit 31, as described above. In addition, the through current does not flow through the inverter circuit INV1.

Figure 13:
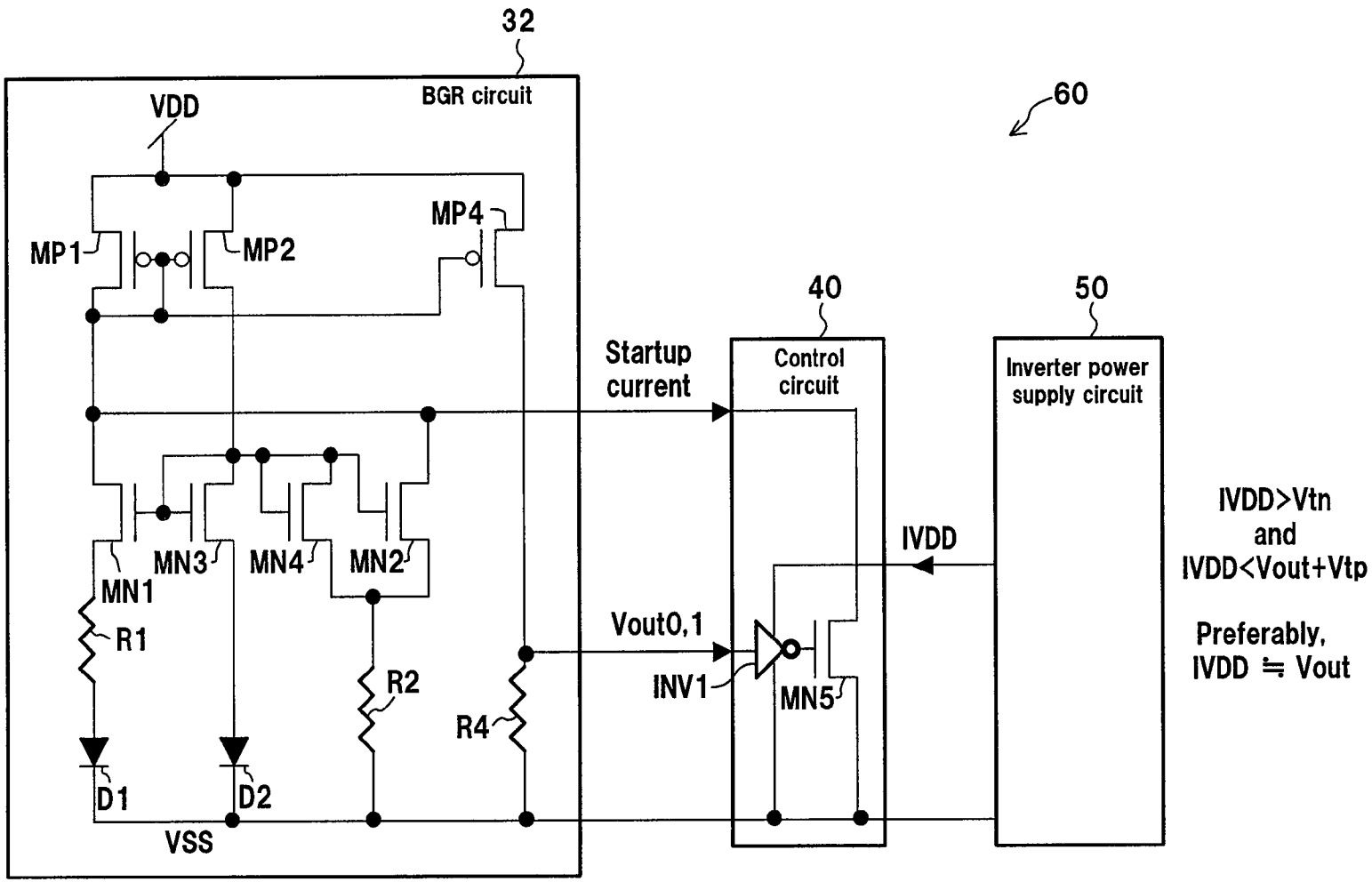
FIG. 13 is a circuit diagram showing a concrete example where the startup circuit is applied to another BGR circuit therein.

The above startup circuit is applicable also to the reference voltage circuit described in Embodiment 7 (FIG. 10), as indicated as a BGR circuit 32 in FIG. 13. In this example, the drain potential of a pMOS transistor MP4 is used as the abnormal state potential Vout0 and the normal state potential Vout1. Accordingly, when IVDD is adjusted so as to satisfy the above condition relative to the abnormal state potential Vout0 and the normal state potential Vout1, the state of the BGR circuit 32 can be transferred to the normal stable state in accordance with the same operation principle. The source potentials of the nMOS transistors MN2, MN4 may be used as the abnormal state potential Vout0 and the normal state potential Vout1, as in FIG. 12.

Figure 14:
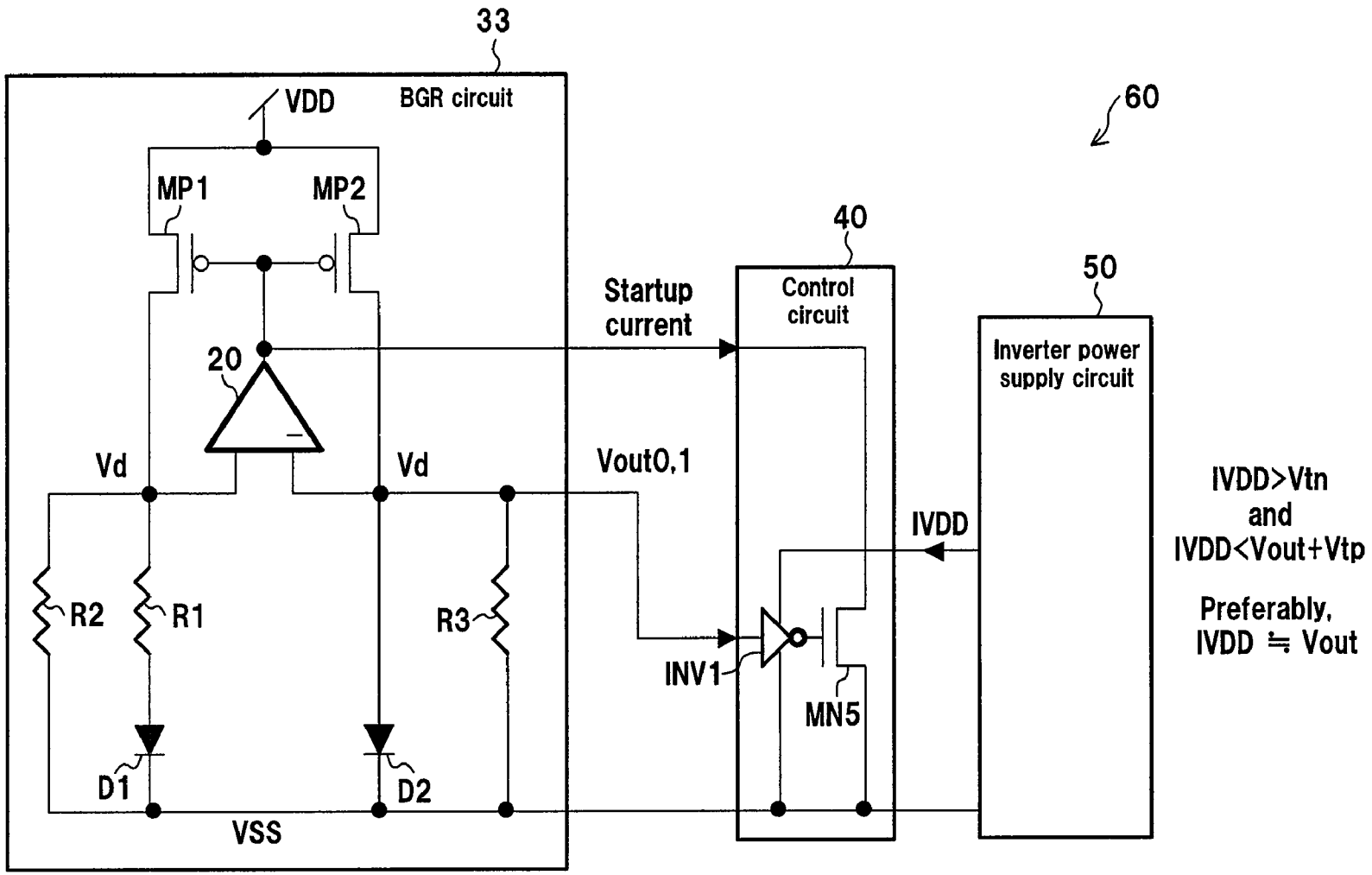
FIG. 14 is a circuit diagram showing a concrete example where the startup circuit is applied to still another BGR circuit therein.

In addition, the above startup circuit is applicable to the reference current circuit (or the reference voltage circuit) shown in FIG. 15, as indicated as a BGR circuit 33 in FIG. 14. In this example, the drain potential of the pMOS transistor MP2 is used as the abnormal state potential Vout0 and the normal state potential Vout1. Alternatively, the drain potential of the pMOS transistor MP1 may be used as them. Any of these configurations can transfer the state of the BGR circuit 33 to the normal stable state in accordance with the same operation principle as that in the description of FIG. 12 and the like.

As described above, the startup circuit shown in FIG. 11 is applicable to a BGR circuit including a state potential output node that outputs the abnormal state potential Vout0 (Vout0≈VSS, for example) in the abnormal stable state while outputting the normal state potential Vout1 (Vout1≧INV1, for example) in the normal stable state.

In the above example, the inverter circuit INV1 has a one-stage configuration composed of the pMOS transistor and the nMOS transistor, but the present invention is not limited thereto. Any inverter circuit having an odd-numbered stage configuration of three-stage or five-stage configuration can be used as far as the logical conformity is met.

In the above example, the nMOS transistor MN5 is turned ON to allow the gate electrode of the pMOS transistor MP2 and the like in FIG. 12 to be connected to the power supply VSS in the abnormal stable state, but the present invention is not limited thereto and may be applicable to a configuration in which the startup current from the power supply VDD is allowed to flow by providing an additional pMOS transistor so that the gate electrode thereof is connected to the power supply VSS through the nMOS transistor MN5 while the gate electrode of the nMOS transistor MN3 and the like in FIG. 12 are connected to the power supply VDD through the additional pMOS transistor.

The elements described in the above embodiments including the modified examples may be combined variously within a theoretically capable range.

INDUSTRIAL APPLICABILITY

The reference current circuits, the reference voltage circuits, and the startup circuits in accordance with the present embodiment exhibit the effects of reducing the necessary resistance to reduce the area of a semiconductor integrated circuit effortlessly, and therefore, are useful as reference current circuits, reference voltage circuits, startup circuits, and the like using a bandgap reference circuit.

The invention claimed is:

1. A reference current circuit, comprising:

a current mirror circuit connected to a first power supply and generating first and second mirror currents at a predetermined current ratio, the first mirror current being distributed to first and second distributed currents while the second mirror current being distributed to third and fourth distributed currents;

a first diode provided in a current path through which the first distributed current flows to a second power supply;

a second diode provided in a current path through which the third distributed current flows to the second power supply;

a first resistor provided in at least one of the current paths in which the first and third distributed currents flow;

a second resistor provided in a current path in which an added current of the second and fourth distributed currents flows added and having one end connected to the second power supply;

first to fourth transistors including drain electrodes on the first power supply side and source electrodes on the second power supply side of current paths in which the first to fourth distributed currents flow, respectively, wherein the first and third transistors control the first and third distributed currents to equalize a difference of potential differences between respective ends of the first and second diodes to a potential difference of ends of the first resistor, and the second and fourth transistors control a current ratio between the second and fourth distributed currents to be the predetermined current ratio.

2. The reference current circuit of claim 1, wherein the predetermined current ratio is 1:1.

3. The reference current circuit of claim 1, wherein the current mirror circuit includes an output transistor including a source electrode connected to the first power supply and a drain electrode and a gate electrode connected to each other, a current flowing through the output transistor is distributed to generate the first and second mirror currents, and a gate potential of the output transistor is output as constant current bias.

4. The reference current circuit of claim 1, wherein the first power supply has a potential higher than the second power supply, the first to fourth transistors are NMOS transistors, and the first and second diodes have cathodes connected on the second power supply side, or wherein the first power supply has a potential lower than the second power supply, the first to fourth transistors are PMOS transistors, and the first and second diodes have anodes connected on the second power supply side.

5. A reference voltage circuit, comprising:

a reference current circuit according to claim 1;

a current mirror output transistor outputting a current in proportion to the first or second mirror current; and a voltage output resistor through which the current output from the current mirror output transistor flows, wherein a voltage generated across the voltage output resistor is output.

6. A startup circuit which transfer an operation state of a reference current circuit according to claim 1 from an abnormal stable state to a normal stable state where appropriate operation is performed, the reference current circuit including a state potential output node outputting an abnormal state potential in the abnormal stable state while outputting a normal state potential in the normal stable state and a startup control node capable of transferring the abnormal stable state to the normal stable state by being grounded, the startup circuit comprising:

an inverter circuit including an inverter pMOS transistor and an inverter nMOS transistor and outputting a supplied inverter power supply potential upon receipt of the abnormal state potential output from the state potential output node in the abnormal stable state of the reference current circuit while outputting a ground potential upon receipt of the normal state potential output from the state potential output node in the normal stable state, an output nMOS transistor including a gate receiving any of the outputs of the inverter circuit and connecting to the ground potential or interrupting the startup control node of the reference current circuit; and an inverter power supply circuit supplying the inverter power supply potential, wherein the inverter power supply potential is set equal to or higher than a threshold voltage of the output nMOS transistor and equal to or lower than a sum of the normal state potential and a threshold voltage of the inverter pMOS transistor.

7. The startup circuit of claim 6, wherein the inverter power supply potential is set within a range of ±0.2 V of the normal state potential.

8. The reference current circuit of claim 1, wherein the second and fourth transistors are formed to have the same current density when currents at the predetermined current ratio flow therein and have gate electrodes connected to each other.

9. The reference current circuit of claim 8, wherein the first and third transistors are formed to have the same current density when currents at the predetermined ratio flow therein, the first and third transistors have gate electrodes connected to one end or the other end of the first resistor, respectively, and the first and second diodes are connected to the source electrodes of the first or third transistors, respectively.

10. The reference current circuit of claim 9, wherein the current mirror circuit generates the second mirror current according to the first mirror current, the first transistor and the first diode are provided in this order in a current path from a distribution node of the first distributed current to the second power supply, the first resistor, the third transistor, and the second diode are provided in this order in a current path from a distribution node of the third distributed current to the second power supply, the first transistor has a gate electrode connected to a connection node between the first resistor and the third transistor, the third transistor has a gate electrode connected to the distribution node of the third distributed current, and the gate electrodes of the second and fourth transistors are connected to one of the distribution node of the third distributed current and the connection node between the first resistor and the third transistor.

11. The reference current circuit of claim 10, wherein the current mirror circuit includes fifth and sixth transistors including gate electrodes connected to each other, the gate electrodes are connected to one of drain electrodes of the fifth and sixth transistors, and potentials of the gate electrodes are output as constant current bias.

12. The reference current circuit of claim 8, wherein the first and third transistors are formed to have the same current density when currents at the predetermined ratio flow therein and have gate electrodes connected to each other, a pair of the first resistor and the first diode connected to each other in series are connected to the source electrode of the first transistor, and the second diode is connected to the source electrode of the third transistor.

13. The reference current circuit of claim 12, wherein the current mirror circuit generates the second mirror current according to the first mirror current, the first transistor and the pair of the first resistor and the first diode connected to each other in series are provided in this order in a current path from a distribution node of the first distributed current to the second power supply, the third transistor and the second diode are connected in this order in a current path from a distribution node of the third distributed current to the second power supply, and the gate electrodes of the first to fourth transistors are connected to one another and are connected to the distribution node of the third distributed current.

14. The reference current circuit of claim 13, wherein the current mirror circuit includes fifth and sixth transistors including gate electrodes connected to each other, the gate electrodes are connected to one of drain electrodes of the fifth and sixth transistors, and potentials of the gate electrodes are output as constant current bias.

15. The reference current circuit of claim 12, wherein the current mirror circuit includes fifth and sixth transistors having gate electrodes connected to each other, the reference current circuit further comprising a differential amplifier circuit of which outputs are connected to the gate electrodes of the fifth and sixth transistors and of which inputs are connected to a distribution node of the first and second distributed currents and a distribution node of the third and fourth distributed currents, the first transistor and the pair of the first resistor and the first diode connected to each other in series are provided in this order in a current path from the distribution node of the first distributed current to the second power supply, the third transistor and the second diodes are provided in this order in a current path from the distribution node of the third distributed current to the second power supply, and the gate electrodes of the first to fourth transistors are connected to one another and are connected to the distribution node of the third distributed current.

16. The reference current circuit of claim 15, wherein potentials of the gate electrodes of the fifth and sixth transistors are output as constant current bias.

17. A reference current circuit, comprising:

a current mirror circuit connected to a first power supply and generating a first and second mirror currents at a predetermined current ratio;

first and second transistors each including a drain electrode connected to the current mirror circuit and respectively allowing first and second distributed currents, to which the first mirror current is distributed, to flow;

third and fourth transistors each including a drain current connected to the current mirror circuit and respectively allowing third and fourth distributed currents, to which the second mirror current is distributed, to flow;

a pair of a first resistor and a first diode connected to each other in series, the pair having one end and anther end respectively connected to a source electrode of the first transistor and the second power supply;

a second diode having one end and another end respectively connected to a source electrode of the third transistor and the second power supply;

a second resistor having one end and another end respectively connected to source electrodes of the second and forth transistors connected to each other and the second power supply; and a differential amplifier circuit receiving potentials of the drain electrodes of the first and third transistors, wherein the current mirror circuit includes fifth and sixth transistors including gate electrodes connected to each other, the differential amplifier circuit is connected at an output thereof to the gate electrodes of the fifth and sixth transistors, and gate electrodes of the first to fourth transistors and the drain electrode of the third transistor are connected to one another.

* * * * *